United States Patent [19]

Frye

[11] Patent Number: 4,870,917

[45] Date of Patent: Oct. 3, 1989

[54] WORK HOLDER FOR SEWING MACHINES

[75] Inventor: Ricky J. Frye, Miamisburg, Ohio

[73] Assignee: MIM Industries, Inc., Miamisburg, Ohio

[21] Appl. No.: 250,379

[22] Filed: Sep. 28, 1988

Related U.S. Application Data

[63] Continuation-in-part of Ser. No. 232,810, Aug. 16, 1988, which is a continuation of Ser. No. 68,256, Jun. 30, 1987, Pat. No. 4,763,587.

[51] Int. Cl.[4] ..... D05B 3/00; D05B 21/00

[52] U.S. Cl. ..... 112/121.12; 112/114; 74/568 R

[58] Field of Search ..... 112/121.12, 121.11, 112/114, 221, 104, 121.15; 74/568 R

[56] References Cited

U.S. PATENT DOCUMENTS

| | | | |
|---|---|---|---|
| 688,961 | 12/1901 | McDonald | 112/121.12 |
| 3,575,121 | 4/1971 | Berube | 112/221 |
| 3,606,849 | 9/1971 | Forte et al. | 112/221 |
| 3,774,558 | 11/1973 | Scholl et al. | 112/121.12 |
| 4,587,910 | 5/1986 | Raines | 112/121.12 |
| 4,589,359 | 5/1986 | Scholl | 112/121.12 |
| 4,643,115 | 2/1987 | Junemann | 112/121.12 X |

*Primary Examiner*—H. Hampton Hunter

*Attorney, Agent, or Firm*—Donald P. Gillette

[57] ABSTRACT

A programmable sewing machine that has a work holder and X-Y actuators to move the work holder about on the bed of the machine is provided with a clamping structure to grasp a workpiece to move it about to form a programmed pattern of stitches in it. The clamping structure includes a clamp and a first quick-release connector to connect the clamp to a clamp foot on the work holder, and it also includes a cloth plate and a second quick-release connector to connect the cloth plate to the work holder under the clamp so that both the clamp and the cloth plate are firmly held by the work holder to move in unison but are both quickly releasable from the work holder to be easily replaced.

13 Claims, 4 Drawing Sheets

WORK HOLDER FOR SEWING MACHINES

This is a continuation-in-part of U.S. Ser. No. 232,810, which was filed 8/16/88 and is a continuation U.S. Ser. No. 068,256, filed 6/30/87, now U.S. Pat. No. 4,763,587, dated 8/16/88.

This invention relates to a work holder of the type used in sewing machines that form two-dimensional stitch patterns on a series of workpieces, one after another. In particular, the invention relates to a work holder that has easily changeable clamping means that are firmly held in place on it while being used to clamp onto a workpiece and hold it firmly in place relative to the work holder while the latter moves about on the sewing surface of the machine to form a pattern of stitches in the workpiece. The clamping means remain firmly held in place for as many repetitions of the sewing operation as may be desired but can be easily removed and replaced by other clamping means to clamp workpieces of a different size.

One of the common repetitive functions in the sewing industry is to sew a label on a panel of material and to repeat that operation over and over as quickly as possible to produce a large number of identical, finished workpieces. Typically, the labels are stitched to the larger panel by rows of stitches formed by moving the panel about on the bed of the sewing machine while the panel is held in a fixed position on the panel. In order to do all this as rapidly as possible and to place the stitches exactly where they should be, the movement of the panel is not directly controlled by a human operator. Instead, sewing machines of the type normally used for this purpose, such as the Mitsubishi Models PLK-0303 and PLK-0604 and others, as well as machines made by other manufacturers for performing computer-controlled stitching, have a cloth plate that rests on the bed of the machine and is connected to a mechanism, known as the X-Y mechanism, that moves the cloth plate in a series of incremental steps in two perpendicular directions. These incremental movements are controlled by a digitally programmed electronic controller, which is capable of causing the cloth plate to move not only in a rectangular pattern to set a label but in much more complex patterns to form letters, numbers, or artistic emblems. All of the movement required to form the pattern of stitches is carried out by the clamping mechanism; the needle moves reciprocatingly in a fixed path that intersects the panel.

The panel of material is clamped against the surface of the cloth plate by a clamp frame that is part of a work holder, which also includes a base and an arm supported by the base. The base is rigidly attached to the cloth plate and to the X-Y mechanism to move in unison therewith according to the stitch pattern to be formed. The arm extends out from the base, and the clamp frame is supported at the free end of the arm. Means are provided to move the clamp frame toward the cloth plate with sufficient firmness to clamp the panel of material against the cloth plate and grip it tightly enough to move precisely in unison with the work holder according to the recorded stitch pattern.

A typical clamp frame consists of four sides surrounding a rectangular open area of the same size and shape as the label to be sewn to the panel. However, it is not enough merely to place a label in the open area and expect it to lie there as if the surrounding sides of the clamp frame were a nest; the label must be pressed against the underlying panel of material so that it will remain in a fixed location as the panel moves in accordance with the stitch pattern. As in the sewing of any material, the label must be held down in the region adjacent the needle to prevent tenting. This may be done by means of a hollow, cylindrical presser foot that surrounds the needle, or it can be done by a plate that is nearly as large as the open area of the clamp frame and is pressed down against the central part of the label by a separate actuator. This leaves a narrow gap between the perimeter of the plate and the inner perimeter of the frame, and the stitches to sew the label to the underlying panel of material can be formed in that gap.

The plate that presses against the central part of the label is supported by a shaft that extends across the gap and would prevent stitches from being formed directly under it. However, if stitches are to be formed in a closed rectangular pattern, the shaft that supports the plate has an eccentric section directly over the location of the gap, and means are provided to pivot the shaft about 180° to throw the eccentric first to one side and then the other so that stitches can be formed in the region that would be covered by a straight shaft having no eccentric.

One of the problems encountered by the users of pattern-stitching machines, especially in attaching labels to panels, is that labels come in different sizes, and each size requires a clamp frame that just fits it. Clamp frames of the type used heretofore have been attached by machine screws to a clamp foot that is moved up and down to release and grip the panel of material onto which the label is to be sewn. When labels of different size are to be sewn by the machine, the operator, or a mechanic, must unscrew the machine screws, remove the clamp frame, align a different clamp frame with the clamp foot, and reinsert and tighten the screws. The cloth plate, which cooperates with the clamp frame in gripping a workpiece must also be changed by unscrewing the screws that hold it in place, lifting it off, putting a different one in its place, and retightening the screws. Moreover, both the clamp frame and the cloth plate must be properly aligned with each other and with the needle, all of which takes a considerable time. During all of that time, the machine is inoperative, and if such changes have to be made often, the cumulative downtime can make the resulting sewn products excessively expensive and non-competitive.

OBJECTS AND SUMMARY OF THE INVENTION

It is an object of this invention to provide improved work holding means in which clamp frames can be changed more quickly than heretofore but with no loss of rigidity, accuracy, or holding power of the clamping structure.

Another object is to provide a cloth plate that can be easily and quickly attached to and removed from a work holder by hand without the use of tools.

Still another object is to provide a structure for the work holder that will allow the clamp frame and the cloth plate to be changed by the operator without having to use a screwdriver or any other tool to do so.

Further objects will be apparent from the following description and the accompanying drawings.

In accordance with this invention, a first type of interconnectable means is located on the structure that supports the clamp frame, and a second type of interconnectable means is located on each clamp frame to be used with that support structure. The first and second types of interconnectable means must interconnect firmly but releasably with each other.

In the context of this invention, the designation of components as being releasable from each other or of a quick-release type denotes that no tools are required to effect such release or the reassembly of those same components or others like them. Most of the components of a sewing machine are put together with the assistance of tools and are described herein as being rigidly assembled. The latter designation also applies to parts that are even more permanently assembled, as by welding and the like.

One type of interconnectable means can comprise a plurality of pins and means to prevent the pins from swiveling relative to each other, as well as from changing the distance by which the pins are spaced apart. The other type of interconnectable means will then comprise a plurality of channels spaced apart by the same distance as the pins and formed in or held by structural means so that they are parallel to each other and are spaced apart by exactly the same distance as the pins to enable the pins to fit snugly therein. In addition to comprising a plurality of channels, the other type of interconnectable means comprises means to prevent the channels from swiveling.

The cloth plate is also arranged so that the forward part is releasably attached to the rear part attached to the work holder and can be quickly separated from the rear part without the use of tools. A base part is affixed to the work holder, and an adapter is attached to the rear part of the revised cloth plate, and the base part and the adapter are provided with interconnectable means that fit precisely together so that they can be joined in only one position. They are held in that position by means, such as a pivotal arm that can be operated by hand.

DETAILED DESCRIPTION OF THE INVENTION

Figure 1:
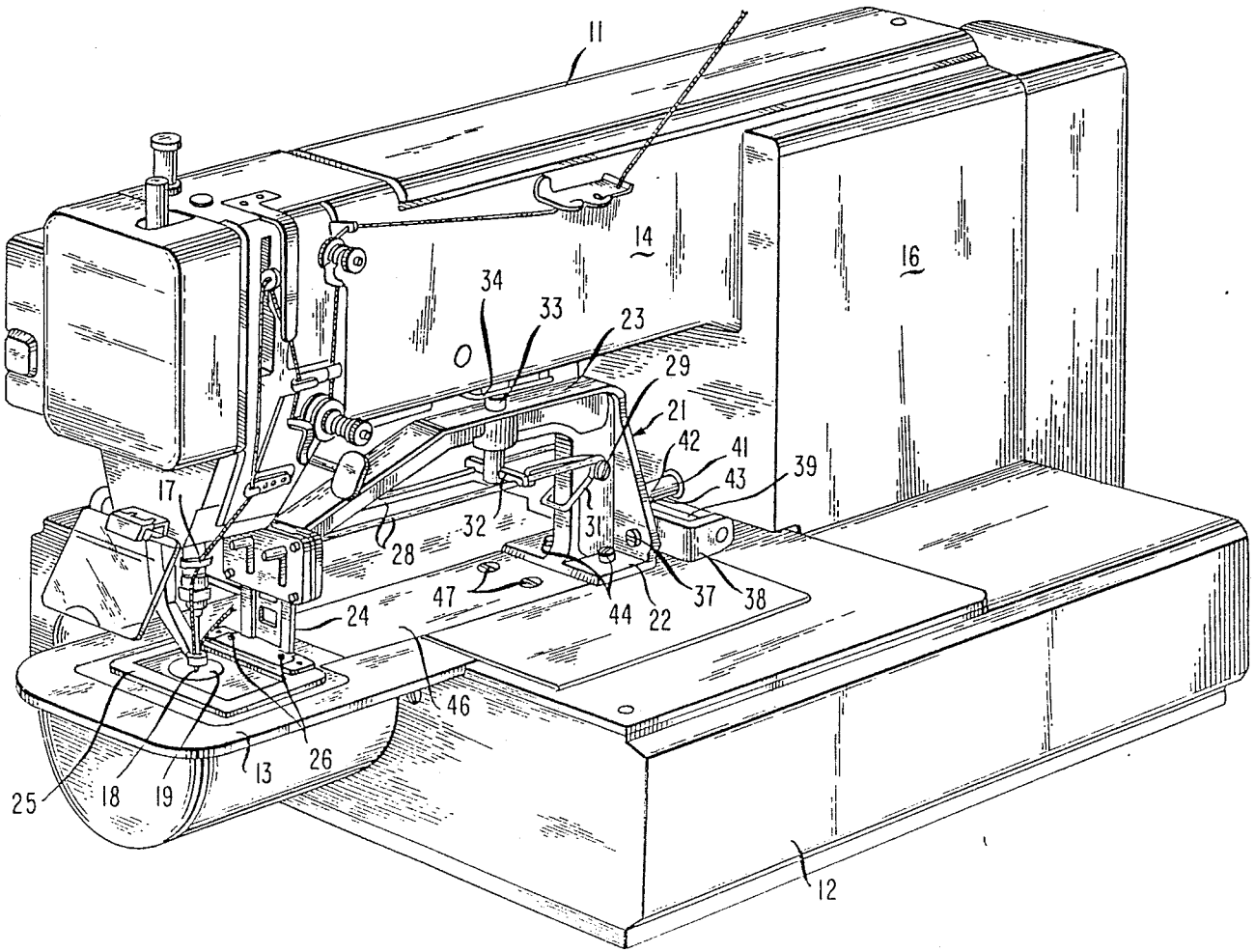
PRIOR ART FIG. 1
FIG. 1 is a perspective view of an existing sewing machine of a type with which this invention is to be used.

FIG. 1 shows one of the sewing machines currently being used to form patterns of stitches under the control of a computer and a stored program. The machine 11, which, in FIG. 1, is a Mitsubishi Model PLK-0604, but which could be any of a number of other pattern-forming machines made by Mitsubishi or by other manufacturers, includes a base 12 with a sewing surface 13 and a horizontal arm 14 that extends out over the sewing surface, or bed, and is supported by a standard 16. A needle bar 17 near the end of the arm supports a needle 18 for reciprocating motion in a fixed path that is vertical and perpendicular to the sewing surface 13. The needle moves down through a hole in a throat plate 19 at the bottom of its stroke to transfer a loop of thread to a looptaker under the sewing surface. The looptaker is not shown in the drawing but is a typical rotary hook in the Model PLK-0604. The looptaker and needle are part of the stitch-forming mechanism of the machine 11, and both are connected to a main motor (not shown) to be driven by it.

The machine 11 does not have a conventional feed dog. Instead, the workpieces in which stitches are to be formed are held in a work holder 21 that includes a base 22, an arm 23, a clamp foot 24, and a clamp frame 25 that is attached by machine screws 26 to the clamp foot. A pair of rods 28 mounted on a pivot pin 29 engage the clamp foot 24, as will be more clearly shown in FIGS. 2 and 3, to raise and lower it. These rods are resiliently biased by a spring 31 to urge the rods to their uppermost position. A yoke 32 supported at the lower end of a vertical shaft 33 slidably guided in the arm 23 rests on the rods 28 and is pressed downward by downward movement of a plate 34. The latter, in turn, is controlled by a solenoid (not shown) in the horizontal arm 14 of the machine 11.

The base 22 of the work holder 21 is attached by machine screws 37, only one of which is visible in FIG. 1, to a yoke 38 that supports the ends of a shaft 39. Both the yoke and the shaft 39 extend in a direction defined as the X direction. A coupling shaft 41 has a T-shaped coupling 42 rigidly attached to its forward end, and the cross bar 43 of the coupling 42 fits closely but slidably around the shaft 39 to transmit longitudinal, or Y-directed, movements of the coupling shaft 41 to the shaft 39 and the yoke 38 and, thereby, to the work holder 21. Such movements of the coupling shaft 41 may be imparted to it by a stepping motor in the housing 16 by means of an endless belt to which the shaft 41 is clamped and which is driven by the motor. Alternatively, the coupling shaft may be provided with teeth like a rack and driven directly by a pinion mounted on the shaft of the stepping motor. Such a rack-and-pinion drive makes it possible to obtain greater Y-direction movement of the coupling shaft 41, and, thus, of the work holder 21, than can be achieved if the coupling shaft 41 is clamped to a belt driven by the stepping motor.

The base 22 of the work holder is attached by two machine screws 44 to a carriage in the base 12 of the machine, so that Y-directed movement of the work holder is transmitted to the carriage. A cloth plate 46 is connected to the same carriage by two machine screws 47 to move exactly in unison with the work holder 21.

The carriage is clamped to a toothed belt looped around two pulleys spaced apart in the X direction in the base of the machine 11, and that belt is driven by a second stepping motor within the base 12. That motor moves the toothed belt, and thus the carriage and the work holder and the cloth plate 46, in the X direction. Such movement of the work holder 21 in the X direction does not hinder movement of the work holder in the Y direction due to longitudinal movement of the coupling shaft 41, because the carriage on which the work holder 21 is mounted is constrained by bearings to move the same distance in the Y direction for a given mount of Y-directed movement of the coupling shaft 41 transferred through the T-shaped coupling 42 wherever that coupling happens to be along the shaft 39.

The X and Y dimensions of the plate 34 must at least be equal to the maximum distance that the work holder 21 can move in the X and Y directions so that, no matter where the work holder is located within its X and Y ranges of travel, the shaft 33 will be under the plate 34. As long as that is the case, downward movement of the plate 34 will always push the shaft 33 and the rods 28 downward when the solenoid in the horizontal arm 14 is activated.

The purpose of moving the rods 28 downward is to force the clamp foot 24 downward against the upward force of the spring 31. The solenoid in the horizontal arm 14 has sufficient force to overcome the force of the spring 31 easily and to press the clamp frame 25 down upon any panel of material laid upon the cloth plate 46. The magnitude of such force is easily sufficient to pinch, or grasp, such material forcefully enough to cause the panel of material to move exactly in unison with the movement of the work holder 21 throughout its entire X and Y ranges of motion.

Figure 2:
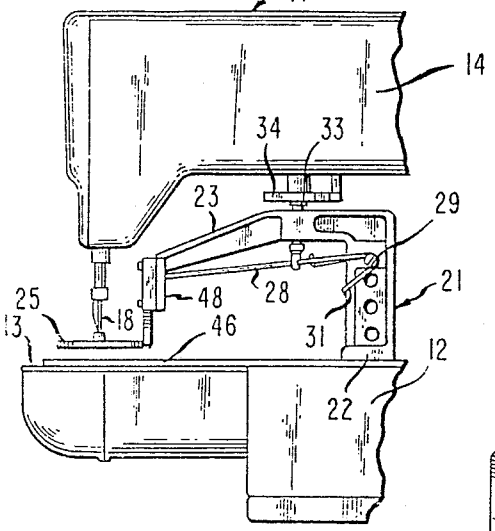
FIG. 2 PRIOR ART
FIG. 2 is a side view of a fragment of the machine in FIG. 1 showing, particularly, one embodiment of a work holder used on that machine.

FIG. 2 shows the clamp foot 24 and the clamp frame 25 in their most elevated position, as they would be to allow a panel of material to be inserted between the clamp frame and the sewing surface 13, or, more precisely, between the clamp frame and the cloth plate 46.

Figure 3:
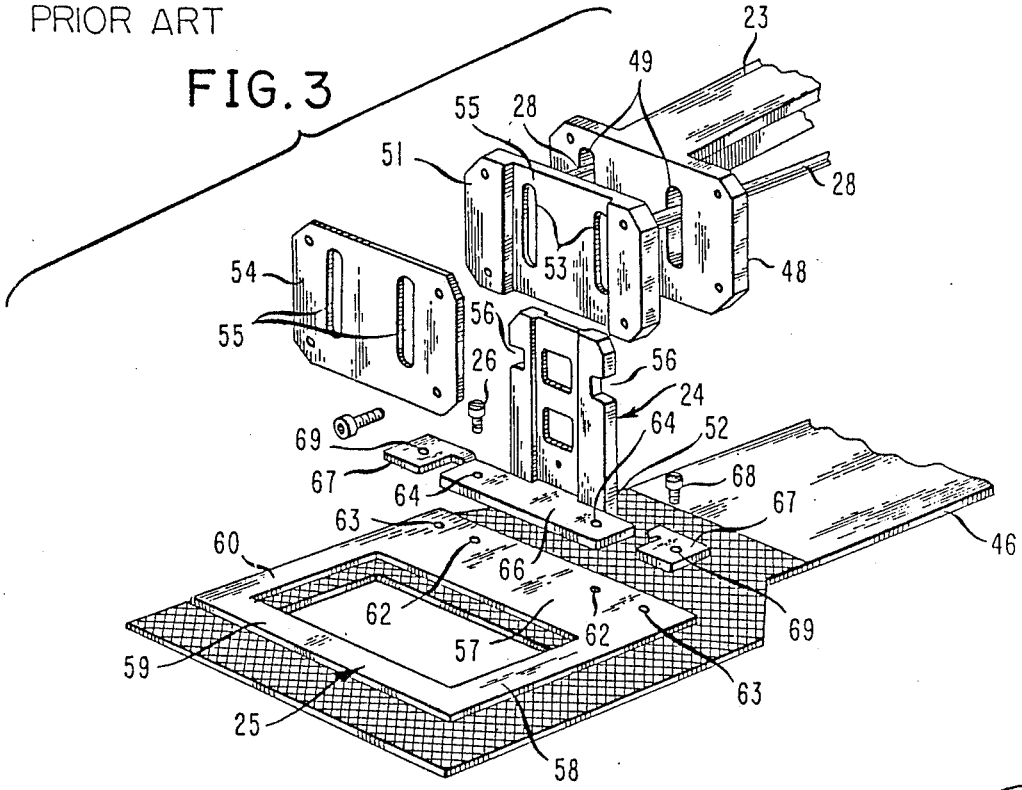
PRIOR ART FIG. 3
FIG. 3 is a perspective, exploded view of a fragment of the work holder in FIG. 2.

FIG. 3 shows more clearly the components associated with the free end of the work holder arm 23 to accommodate up-and-down movement of the clamp frame 25. In this embodiment, the free end of the arm terminates in a vertical plate 48 that has two vertical slots 49 in it through which the rods 28 extend. A work holder guide plate 51 is mounted in surface-to-surface contact with the plate 48 and is provided with a slot just wide enough and deep enough to accommodate the vertical part 52 of the clamp foot 24 and to allow it to slide easily up and down. There are two slots 53 aligned with the slots 49. The rods 28 would normally pass through these slots 53 if the guide plate 51 were in contact with the plate 48, but the exploded location of the plate 51 in FIG. 3 is beyond the ends of the rods. A cover plate 54 is held in surface-to-surface contact with the guide plate 51 to transform the open slot 55 into a closed tunnel to hold the vertical part 52 of the clamp foot in place when the plates 48, 51, and 54 are joined together by machine screws.

The vertical part 52 of the clamp foot 24 has two notches 56 that are spaced apart horizontally the same distance as the slots 49, 53, and 55 and are wide enough vertically to allow the rods 28 to fit therein. Thus, vertical movement of the rods is transmitted to the clamp foot 24.

The clamp frame 25 in this embodiment is shown as a rectangular plate with a rectangular open area surrounded by four sides 57–60. The side 57 has two pairs of threaded holes 62 and 63 in it. The inner holes are aligned with a pair of holes 64 in the horizontal plate 66 at the bottom of the clamp foot 24, and the machine screws 26 through the holes 64 and threaded into the holes 62 hold the clamp frame rigidly attached to the clamp foot. In order to facilitate aligning the clamp frame 25 with the plate 66, two guides 67 are rigidly attached to the side 57 by means of a pair of machine screws 68 that pass through holes 69 in the guides 67 and are threaded into the outer pair of holes 63 in the side 57 of the clamp frame 25. One corner of each of the guides 67 is cut away to fit around a corner of the horizontal plate 66 to make it easier to align the holes 64 with the holes 62 when changing clamp frames. Even so, it is a relatively time-consuming operation to unscrew the screws 26 to remove one clamp frame and then to align another clamp frame, even with the assistance of the guides 67, and, finally, to replace the screws 26.

Figure 4:
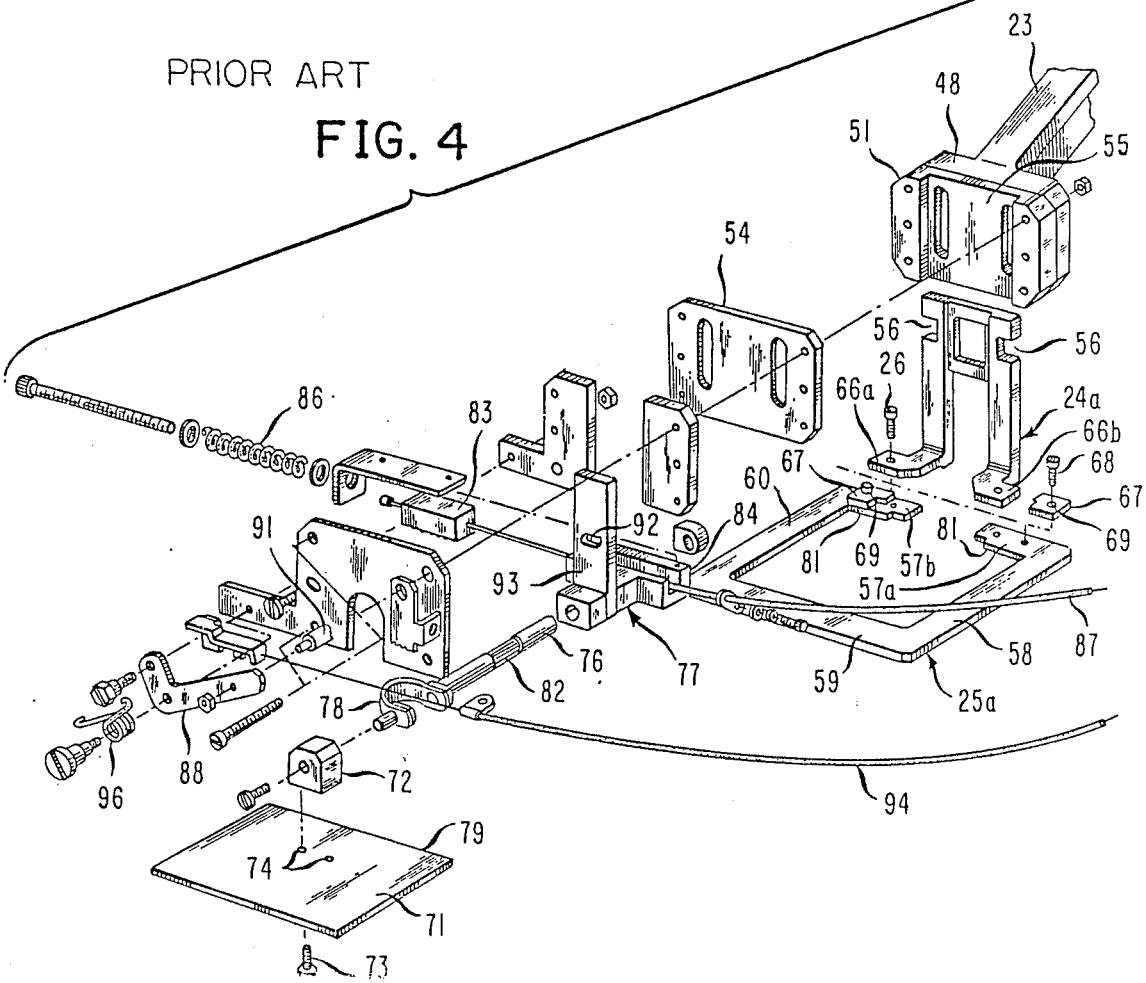
PRIOR ART FIG. 4
FIG. 4 is a perspective, exploded view of a fragment of a different type of work holder currently used with the machine in FIG. 1.

When a completely closed clamp frame, such as that shown in FIG. 3 is used, it is possible to form stitches anywhere within the area bounded by the sides 57–60, and this may be done on a single panel of material gripped between the clamp frame 25 and the cloth plate 46 or on a label, or other small panel, laid within the open area bounded by the sides 57–60. In either case, some means, such as the cylindrical presser foot 20 in FIG. 1 must be used to keep the material from tenting as the needle 18 is withdrawn during the formation of each stitch. When the pattern of stitches is only to be a closed rectangle very close to the perimeter of a rectangular label, a structure such as that shown in FIG. 4 is frequently used. This structure includes a C-shaped clamp frame **25*a* attached to a divided horizontal plate 66*a* and 66*b* at the bottom of a modified clamp foot 24*a*. The same guides 67 are used in the embodiment in FIG. 3 to facilitate aligning the clamp frame 25*a* with the horizontal plate 66*a*. In place of a cylindrical presser foot 20, the embodiment in FIG. 4 includes a plate 71 that nearly fills the open area bounded by the sides 57*a*, 57*b*, and 58–60. The plate 71 is attached to the bottom of a block 72 by machine screws 73 that extend up through holes 74 in the plate 71. The block is pivotally mounted on the end of a swing shaft 76 that is, in turn, pivotally supported in a swing shaft block 77. The shaft 76 has an eccentric 78 that, when the components in FIG. 4 are all assembled, is directly over the gap between the edge 79 of the plate 71 and the edges 81 of the sides 57*a* and 57*b* of the clamp frame 25*a*. The purpose of the eccentric is to keep any part of the perimeter of a label nested in the open area of the clamp frame 25*a* from being permanently hidden from directly above it, as would be the case if there were no eccentric and, instead, the shaft 76 simply extended straight from the block 72 to the block 77. The shaft 76 has pinion teeth 82 formed in it, and a rack 83 is held within a slot 84 in the block in position so that the teeth of the rack 83 mesh with the pinion teeth 82. The rack is moved to one end of its range of movement by a spring 86 and to the other end by a flexible shaft 87 controlled by a solenoid. When the rack 83 is at one end of its range of travel, the eccentric 78 is in the position shown, and when the rack is at the other end of its range of travel, the eccentric is approximately 180° away from the position in which it is shown. In the first position, one part of the gap between the edges 79 and 81 is covered by the eccentric, but stitches can be formed alongside the entire rest of the perimeter of the plate 71 between that plate and other parts of the edges 81 and between the plate and the sides 58, 59, and 60. Then, when the eccentric is thrown over to its alternative position, the part of the gap previously covered by the eccentric will be clear of that obstruction, and stitches can be formed in it, completing an uninterrupted rectangle of stitches around the plate 71**.

The plate 71 can be lifted above the level of the clamp frame 25*a* by a bell crank lever 88 pivotally mounted on a plate 89 rigidly attached to the arm 23. A pin 91 mounted near the end of one arm of the lever 88 engages a slot 92 in a post portion 93 of the block 77, so that when the lever 88 is pivoted counterclockwise by a flexible shaft 94, the block 77 is lifted up. The flexible shaft 94 is actuated by a solenoid (not shown). In order to keep the block 77 properly oriented as it is lifted up and later allowed to move down, primarily in response to the force of a spring 96 that engages one arm of the lever 88 and a projection 97 extending from one side of the plate 89, the post portion 93 is guided between two swing shaft guides 98. These guides are stacked between the cover plate 54 and the plate 89 as part of the stack of plates including the guide plate 51 and the plate 48 at the end of the work holder arm 23.

Figure 5:
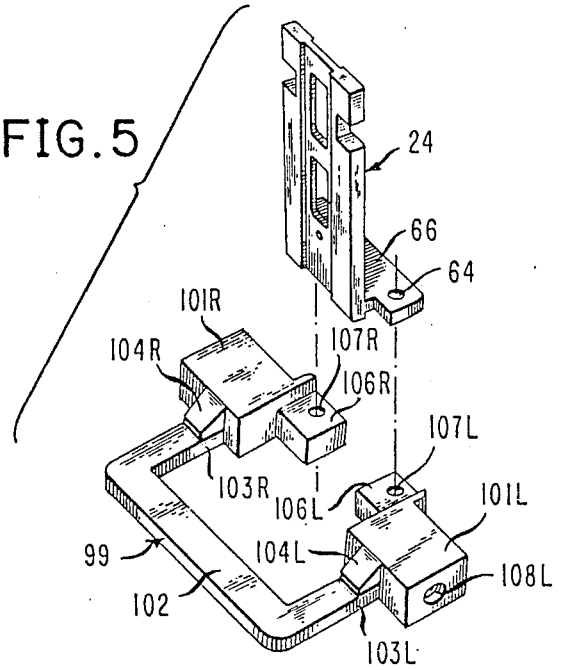
FIG. 5 is a perspective, exploded view of one part of a work holder structure in accordance with this invention.

In accordance with this invention, a structure 99 shown in FIG. 5 is attached to the horizontal plate 66 of the clamp foot 24. This structure includes left and right locating housings 101L and 101R, which are mirror images of each other, and a joining bracket 102 rigidly and permanently joined to the housings. Such rigid connection between these parts may be accomplished by silver soldering the ends 103L and 103R of the bracket 102 to corners created at the rear surfaces of the housings 101L and 101R by overhanging shelves 104L and 104R extending from the respective rear surfaces. The joining bracket 102 thus serves as means to hold the housings 101L and 101R in absolutely fixed position with relation to one another.

The housings 101L and 101R also have projections 106L and 106R that extend directly toward each other and are bolted to the under surface of the horizontal plate 66 by machine screws that pass through the holes 64 (only one of which is shown in FIG. 5) and enter threaded holes 107L and 107R aligned with the holes 64. Although each housing 101L and 101R is joined to the clamp foot 24 by only a single screw, the fact that the housings are rigidly joined together by the bracket 102 prevents any swiveling of either housing relative to the other or to the clamp foot.

Both of the housings 101L and 101R have threaded holes entering their outwardly facing walls; only the hole 108L is visible in FIG. 5. These holes allow detent means to be inserted into the housings 101L and 101R and to be adjusted after they have been inserted.

Figure 6:
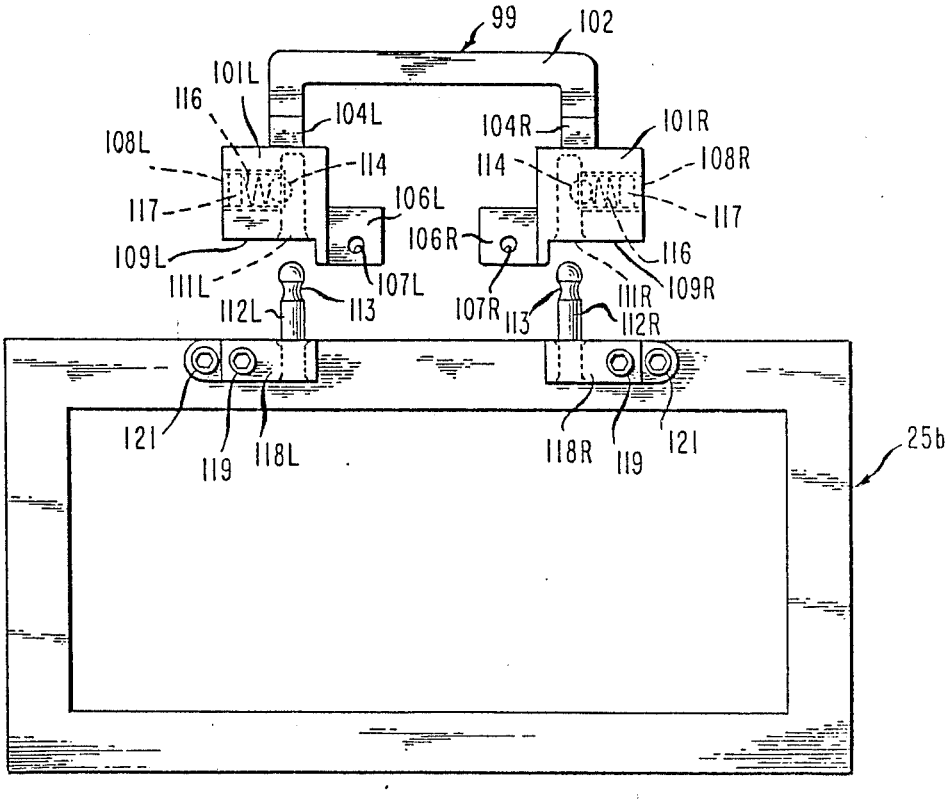
FIGS. 6 and 7 show top and side views of the structure in FIG. 5.

FIG. 6 shows a top view of the structure 99 ready for a clamp frame to be attached to it. Each housing has a front surface 109L and 109R, and the bracket 102 holds the housings so that these flat front surfaces are coplanar with each other. Each of the front surfaces is pierced by a hole 111L and 111R, respectively, that extends straight into the respective housing perpendicular to the front surface, so that these holes are parallel to each other. This is essential to permit pins 112L and 112R rigidly attached to the clamp frame 25*b* parallel to each other to be inserted into these holes. The diameter of the pins is just slightly less than that of the holes 111L and 111R, which allows the pins to fit snugly into the holes. In addition, the pins have grooves, or recesses, 113 near their tips to be engaged by holding means such as detent balls 114 within the threaded holes 108L and 108R in the housings 101L and 101R. Springs 116 held in place by set screws 117 exert enough side pressure on the pins to hold them firmly in place once they have been plugged into the holes 111L and 111R. The forces holding the pins 112L and 112R in place prevent any movement of the clamp frame 25*b* in response to sewing pressures or forces, although the clamp frame and the pins can be removed by the operator using only hand pressure without any tools.

The pins are rigidly mounted in holding blocks 118L and 118R, for example, by being silver-soldered in holes in the blocks. Each of the blocks is attached to the clamp frame 25*b* by two cap screws 119 and 121 that are screwed into threaded holes in the clamp frame. The locations of the holes for the screws 119 and 121 in both the blocks 118L and 118R and the clamp frame 25*b* is such that the pins 112L and 112R will be exactly aligned with the holes 111L and 111R in the housings 101L and 101R. Furthermore, the fact that each block 118L and 118R is attached to the clamp frame by two screws prevents any swiveling of either block and its pin relative to the other block and its pin or relative to the clamp frame.

Figure 7:
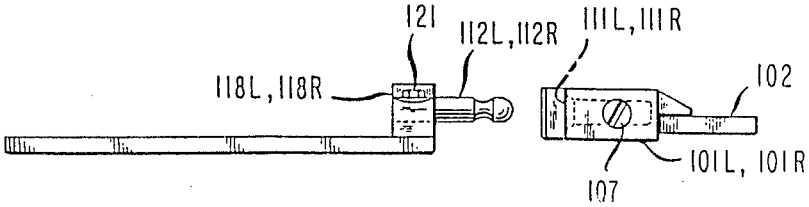

FIG. 7 is a side view showing the clamp frame 25*b* positioned so that its pins 112L and 112R are directly in line with the holes 111L And 111R in the housings 101L and 101R attached to the clamp foot.

Figure 8:
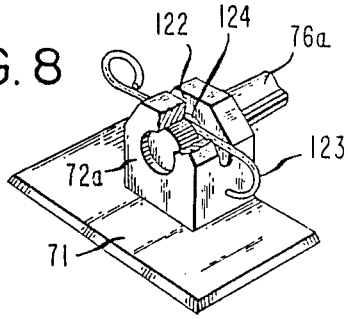
FIG. 8 is a perspective view of a modification of FIG. 4.
Figure 9:
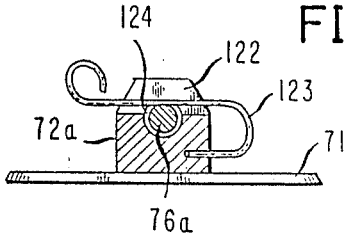
FIG. 9 is a cross-sectional view of the apparatus in FIG. 8.

FIGS. 8 and 9 show a modification of the block 72 on the plate 71 and of the shaft 76 in FIG. 4 to incorporate features of this invention. The block 72*a* in FIGS. 8 and 9 is just like the block 72 in FIG. 4 except that there is a slot 122 in the block 72*a* and a resilient wire 123 extending from one side of the block 72*a* directly below the slot and curled back to pass through the slot. The wire is a tight press fit in a hole in the block 72*a*. The shaft 76*a* has a groove 124 into which the wire presses within the block 72*a*. Unlike the shaft 76 in FIG. 4, which is retained in the block 72 by a screw in the end of the shaft, the only thing that holds the block 72*a* and the shaft 76*a* together is the interengagement of the wire 123 with the slot 122 in the block and with the groove 124 in the shaft. In order to remove the plate 71, all that need be done is to lift the end 126 of the wire 123, which has a curl for safety in handling it, and slide the block 72*a* off of the shaft 76*a*. As may be seen, the depth of the groove 124 is greater than half the diameter of the wire and, in fact, is greater than the diameter. It is necessary, of course, that the location of the groove 124 along the shaft 76*a* and the location of the slot 122 in the block 72*a* be so related that the edges of the plate 71 in FIGS. 8 and 9 will be spaced from the edges defining the open area in a clamp frame similar to the frame 25*a* in FIG. 4.

In FIG. 5, which illustrates some of the features of this invention, the housings 101L and 101R are joined to the bracket 102 in such a position that the mounting holes 107L and 107R are spaced apart by exactly the same distance as the holes 64 in the horizontal plate 66. Thus, it is not necessary to modify the clamp foot 24 to make use of this invention. The same is true of the embodiment in FIG. 4, which shows a modified clamp foot 24*a* that has a horizontal plate divided into two parts 66*a* and 66*b*. The mounting holes in those two parts are spaced the same distance apart as the holes 64 in FIG. 3. Since the two housings 101L and 101R are spaced apart, the structure 99 in FIG. 5 can be directly attached to the two-part horizontal plate 66*a* in FIG. 4 without any modification of the clamp foot 24*a*. Thus, in order to make use of the plate 71 with the slotted block 72*a* on it, as shown in FIGS. 8 and 9, all that is necessary is to attach the blocks 118L and 118R of FIGS. 6 and 7 to a C-shaped clamp frame like the clamp frame 25*a* in FIG. 4. The blocks 118L and 118R would require different mounting hole locations in the clamp frame than are used in the clamp frame 25*a* in FIG. 4, but other dimensions of the clamp frame could remain the same as if that frame were to be used in the apparatus in FIG. 4.

Figure 10:
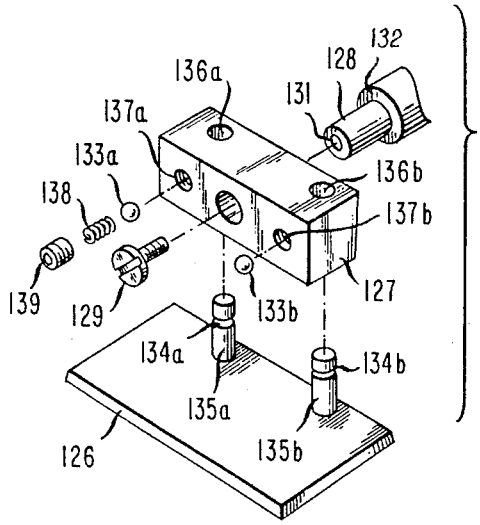
FIG. 10 is an exploded, perspective view of an alternative device to be used in place of the apparatus in FIGS. 8 and 9.

FIG. 10 shows a center plate 126 that performs the same function as the plate 76 in FIGS. 8 and 9 and, like it, is connected to a swing shaft by a block. However, the block, which is identified by reference numeral 127, is not releasably attached to the shaft 128, as the block 72*a* is to the shaft 71 in FIGS. 8 and 9, but is retained by a screw 129 that engages a threaded hole 131 in the end of the shaft. The shaft 128 has a shoulder 132, and, in this embodiment, the block is captured between the shoulder and the head of the screw, although other retention means can be used instead.

The plate 126 is releasably attached to the block 127 by quick-release means consisting of a pair of detent balls 133*a* and 133*b* that engage grooves 134*a* and 134*b* in a pair of parallel pins 135*a* and 135*b* rigidly attached to the plate 126 and extending vertically from the plate. The pins fit snugly but slidably in a pair of parallel holes 136*a* and 136*b* in the block 127, and in order to engage the grooves 134*a* and 134*b* when the pins are fully inserted (to the point that the top surface of the plate 126 is against the underside of the block 127) into the holes 136*a* and 136*b*, the detent balls 133*a* and 133*b* are pressed into intersecting holes 137*a* and 137*b*. The pressure that forces each of the detent balls 133*a* and 133*b* against the respective groove 134*a* and 134*b* is provided by a detent spring, and the amount of pressure is controlled by a set screw in each of the threaded holes 137*a* and 137*b*. Such detent arrangements, in themselves, are well known, and therefore, for the sake of clarity of the drawing, only one detent spring 138 and one set screw 139 are shown.

The plate 126 can be removed without the use of tools by pivoting the lever 88 in FIG. 4 counterclockwise to lift the plate away from the sewing surface of the machine and exerting downward hand pressure on the top surface of the plate to overcome the retention force produced by the detent spring means acting on the detent balls 133*a* and 133*b*. Once the pins 135*a* and 135*b* are clear of the block, the plate 126 can be taken away and the pins 135*a* and 135*b* of another plate 126 inserted into the holes 136*a* and 136*b*.

Figure 11:
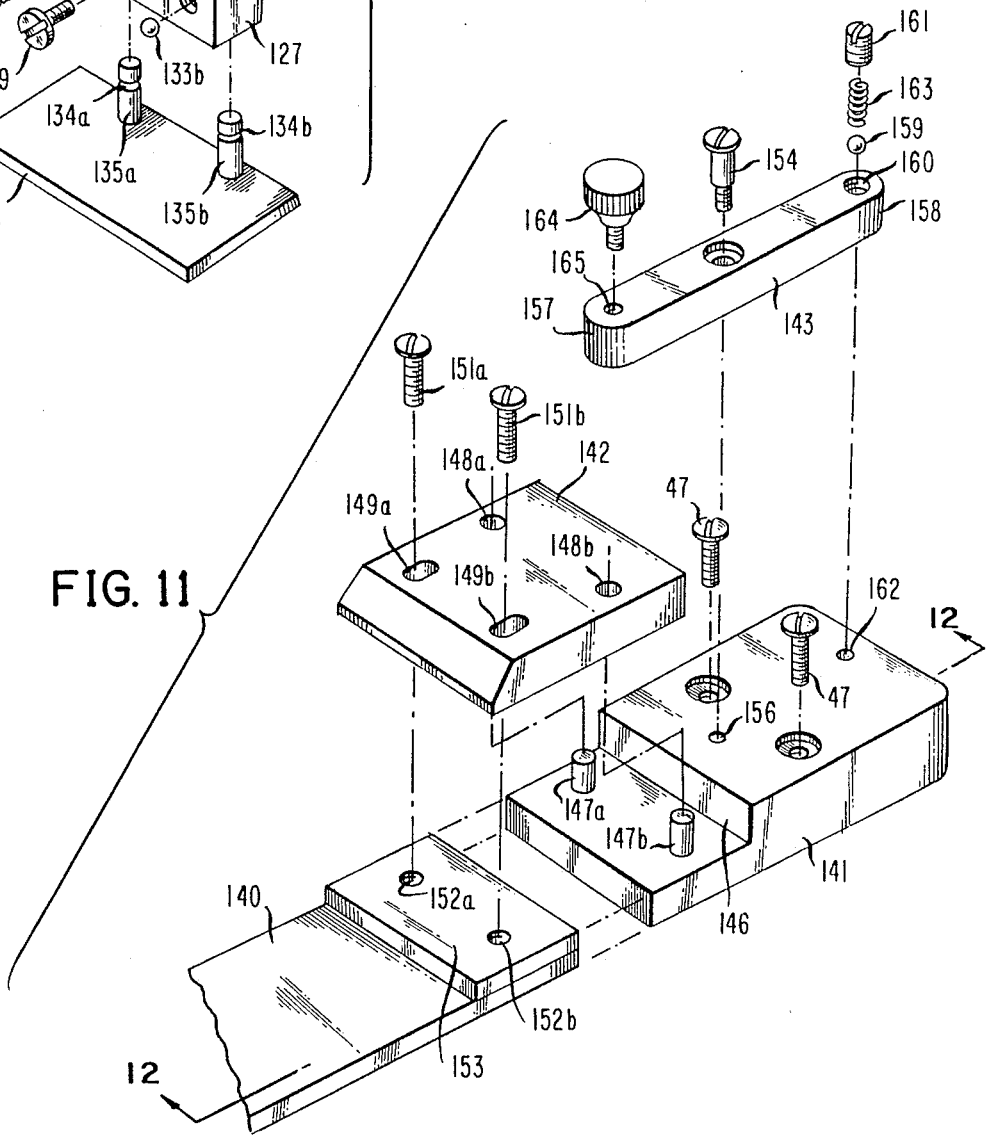
FIG. 11 is an exploded, perspective view of a fragment of a quick-change cloth plate according to this invention.
Figure 12:
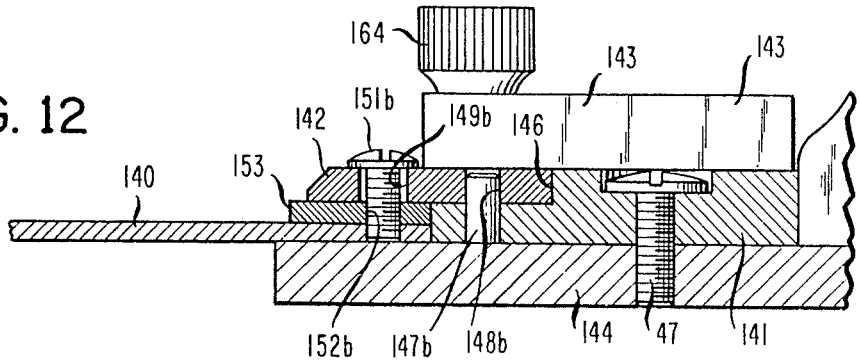
FIG. 12 is a cross-sectional view of the part of the cloth plate in FIG. 11 attached to the member that moves the work holder about on the sewing surface of the machine in FIG. 1.

FIGS. 11 and 12 show only a fragment of the tongue of a cloth plate 140 that is part of a quick-release assembly. The forward end of the cloth plate is not shown but is the same as the forward end of the cloth plate 46 shown in FIG. 1. The quick-release components include a base plate 141, an adapter plate 142, and a retaining arm 143. The bottom surface of the base plate 141 is substantially in the same plane as the sewing surface 13 of the machine, as is the bottom surface of the cloth plate 140. The base plate takes the place of the rear end of the tongue of the cloth plate 46 in FIG. 1 and is rigidly attached to a carriage 144 by screws 47. It is this carriage that conveys the X and Y movements of the work holder 21 to the cloth plate. The base plate can be attached to the carriage 144 by the screws 47 because it is not to be removed in changing from one cloth plate to another, and it must remain in a fixed position on the carriage.

In this embodiment, the rear portion of the base plate 141 is thicker than the forward portion, creating a wall 146 between the two portions. There are two short guide pins 147*a* and 147*b* extending vertically from the upper surface of the forward portion, and the adapter plate 142 has to guide holes 148*a* and 148*b* that are precisely aligned with the pins and are just large enough in diameter to slide onto them. The wall 146 helps guide the adapter plate into position. Because of the close fit between the guide holes 148*a* and 148*b* and the guide pins 147*a* and 147*b*, the adapter plate fits into only one position on the base plate 141, thereby preserving the accuracy of placement from the carriage 144 through the base plate to the adapter plate.

The forward end of the adapter plate 142 has two holes 149*a* and 149*b* that are enlarged into short slots. This end of the adapter plate overlaps the rearmost end of the cloth plate 140 and is rigidly attached to that end by two screws 151*a* and 151*b* that extend through the enlarged holes 149*a* and 149*b* into two threaded holes 152*a* and 152*b*, respectively, in the end portion of the cloth plate. To provide sufficient thickness for the screw to engage the cloth plate firmly, an additional piece of metal 153 is spot-welded to the upper surface of the cloth plate, which also makes the combined thickness of that part of the cloth plate 140 and the additional piece of metal 153 approximately equal to the thickness of the adjacent forward portion of the base plate 141. This allows the adapter plate 142 to rest flat, partly on the top surface of the additional piece of metal and partly on the upper surface of the forward portion of the base plate.

The retaining arm 143 is pivotally mounted on a screw 154 threaded into a hole 156 in the base plate 141 and is long enough so that one end 157 can extend over the adapter plate when the arm is pivoted to be parallel to the longitudinal direction of the cloth plate 140. This end also swings over the locations of the pins 147*a* and 147*b*, which are kept short enough not to interfere with movement of the arm 143. More specifically, the total length of the pins is approximately equal to the combined thickness of the overlapping parts of the base plate 141 and the adapter plate 142. In fact, the length of the arm is great enough and the location of its pivot axis is so close to the wall 146 that at least part of the arm extends over the adjacent part of the adapter plate except when the arm is turned so that it is almost perpendicular to the longitudinal direction of the cloth plate. Only in the latter position of the arm can the adapter plate 142 with the cloth plate 140 rigidly attached to it be disengaged from the base plate. To keep that from happening inadvertently, the other end 158 of the arm 143 has a detent ball 159 held in a hole 160 by a set screw 161 and pressed against the upper surface of the rear portion of the base plate 141 by a spring compressed between the set screw and the detent ball. A recess 162 near the rear of the base plate 141 is located under the arc of movement of the detent ball 159 and is deep enough and of the proper diameter to receive enough of the ball to hold the arm 143 aligned with the longitudinal direction of the cloth plate. A knob is screwed into a threaded hole near the other end of the arm to facilitate pivoting the arm out of the way of lifting the adapter plate off of the pins 147*a* and 147*b* and putting another adapter plate, with a different cloth plate, in its place. The knob also facilitates pivoting the arm 143 back to the position in which the detent ball engages the recess 162 so that the end 157 will hold down another adapter plate 142 to which a different cloth plate has been attached.

The purpose of enlarging the holes 149*a* and 149*b* in the adapter plate is to allow a small amount of freedom in initially attaching an adapter plate to a cloth plate, in case there is any misalignment in the opening in the cloth plate. It is important that no part of the cloth plate ever be in the path of the needle 18 (FIG. 1). Once an adapter plate is properly positioned on a cloth plate and the screws 151*a* and 151*b* are tightened, that cloth plate and adapter plate can be removed and put back as often as desired without having to take the time to realign it again. This is an further advantage of the quick-release construction over the prior cloth plate 46 shown in FIG. 1.

While the components shown in FIGS. 3 and 4 are similar to those used by Mitsubishi, the invention is not limited to Mitsubishi machines and especially not to just certain models of pattern-forming machines. Other models and machines manufactured by other companies can benefit equally well from the quick-change structures defined by the following claims.

What is claimed is:

1. In a sewing machine comprising a sewing surface, work holder means comprising means comprising a cloth plate and clamping means movably mounted in juxtaposition to the cloth plate to grasp a workpiece, a needle reciprocatingly movable to form stitches in the workpiece, a work holder connected to the cloth plate and clamping means to control the operation thereof to grasp and release each workpiece, and means connected to the work holder to move it and the workpiece about on the sewing surface according to a stitching program to form a predetermined pattern of the stitches in the workpiece, the invention comprising:

(a) first quick-release means to connect the clamping means firmly but releasably to the work holder, the first quick-release means comprising:

(i) first guiding means attached to the work holder and precisely positioned with respect to it, and (ii) second guiding means attached to the clamping means and precisely positioned with respect to it, the second guiding means interfitting precisely with the first guiding means, whereby the clamping means will be in a precise position relative to the work holder; and (b) second quick-release means to connect the cloth plate firmly but releasably to the work holder.

2. The invention as defined in claim 1 in which the second quick-release means comprises:

(a) base means rigidly attached to the work holder;

(b) third guiding means in a certain position on the base means;

(c) adapter means comprising fourth guiding means in a certain position on the adapter means, the fourth guiding means being shaped to engage the third guiding means snugly but releasably;

(d) means rigidly attaching the adapter means to the cloth plate, the adapter means being firmly but releasably interconnectable with the base means in a fixed position determined by the third and fourth guiding means to attach the cloth plate firmly but releasably to the base means in a predetermined position; and (e) hand-operable means to hold the adapter means engaged with the base means and to release the adapter means from the base means.

3. The invention as defined in claim 2 in which the base means and the means rigidly attaching the adapter means to the cloth plate are juxtaposed end to end, and the adapter means overlaps the proximal ends of both of them.

4. The invention as defined in claim 3 in which one of the third and fourth guiding means comprises a plurality of spaced-apart channels, and the other of the third and fourth guiding means comprises a corresponding plurality of pins spaced apart the same distance as the channels to fit snugly therein.

5. The invention as defined in claim 4 in which the pins have a total length not substantially greater than the total thickness of the part of the adapter means that overlaps the base means and the part of the base means overlapped by the adapter means.

6. The cloth plate holding means of claim 5 in which the hand-operable means comprises an arm pivotably mounted on the base means and having one end that swings over the locations of the pins and engages the adapter means.

7. The cloth plate holding means of claim 2 in which the portion of the cloth plate proximal to the base means has a predetermined thickness, and the portion of the base means facing the cloth plate has substantially the same thickness as the proximal portion of the cloth plate.

8. The cloth plate holding means of claim 5 in which the base means is generally platelike and the lower surface thereof is substantially coplanar with the sewing surface and the pins extend upward from the top surface of the part of the base means overlapped by the adapter means.

9. The invention as described in claim 1 in which:

(a) the clamping means comprises first and second clamps;

(b) the first guiding means comprises:

(i) first and second support means attached to separate parts of the work holder and movable relative to each other toward and away from the sewing surface;

(ii) first and second guiding structures on the first and second support means, respectively; and (c) the second guiding means comprises third and fourth guiding structures on the first and second clamps, respectively, interconnectable with the first and second guiding structures, respectively.

10. In a sewing machine comprising a sewing surface on which one workpiece after another is to be placed to have a pattern of stitches formed in it, a needle reciprocatingly movable to form the stitches, a work holder comprising multi-part clamp support means and first and second clamp means supported by separately movable parts of the support means to be moved by the latter toward and away from the sewing surface to hold and release each workpiece, and positioning means connected to the work holder to move it about on the sewing surface relative to the path of the needle according to the pattern of stitches, the invention comprising:

(a) first and second interconnectable attachment means attached separately to spaced-apart regions of the support means;

(b) at least a third interconnectable attachment means on the first clamp means to interconnect firmly but releasably with the first interconnectable attachment means to attach the first clamp means firmly but releasably to a first part of the support means; and (c) at least fourth interconnectable attachment means on the second clamp means to interconnect firmly but releasably with the second interconnectable attachment means to attach the second clamp means firmly but releasably to a second part of the support means separately movable from the first part toward and away from the sewing surface, both the first and second parts of the support means being connected to the work holder, whereby the first and second clamp means and the support means move parallel to the sewing surface as a rigidly joined unit while the first and second clamp means are so attached to the support means.

11. The invention as defined in claim 10 in which:

(a) the first clamp means is a clamp frame;

(b) the second clamp means is a clamp plate spaced laterally from the second clamp means when both clamp means are pressed against a workpiece;

(c) one of the first and third interconnectable attachment means comprises a first plurality of pins spaced apart at predetermined locations;

(d) the other of the first and third interconnectable attachment means comprises a plurality of channels shaped and spaced to receive the first plurality of pins in precise alignment and to engage them firmly but releasably;

(e) the second interconnectable attachment means comprises a shaft that extends parallel to the sewing surface and has a groove in it at a predetermined location along its cylindrical surface; and (f) the fourth interconnectable attachment means comprises:

(i) a member rigidly attached to the clamp plate and having a hole that fits snugly but rotatably on the shaft, and (ii) hand-operable means held by the block in position to engage the groove when the member is in its proper position along the shaft.

12. The invention as defined in claim 11 in which the member has a slot that intersects the hole, and the hand-operable means is a spring mounted on the member to enter the slot and engage the groove when the shaft is properly positioned in the hole.

13. The invention as defined in claim 10 in which:

(a) the first clamp means is a clamp frame;

(b) the second clamp means is a clamp plate spaced laterally from the first clamp means when both clamp means are pressed against a workpiece;

(c) one of the first and third interconnectable attachment means comprises a first plurality of pins spaced apart at predetermined locations;

(d) the other of the first and third interconnectable attachment means comprises a plurality of channels shaped and spaced to receive the first plurality of pins in precise alignment and to engage them firmly but releasably;

(e) the fourth interconnectable attachment means comprises a plurality of guide pins rigidly and precisely attached at predetermined positions on the clamp plate; and (f) the second interconnectable attachment means comprises;

(i) a shaft that extends parallel to the sewing surface, (ii) a member attached to the shaft and having a hole that fits snugly but rotatably on the shaft, (iii) a plurality of guide channels precisely located to receive the guide pins, and (iv) means operable by hand pressure to hold the guide pins in the guide channels and to release the guide pins from the guide channels.

* * * * *